United States Patent [19]

Latimer et al.

[11] Patent Number: 4,808,299

[45] Date of Patent: Feb. 28, 1989

[54] REMOVAL OF COPPER AND IRON FROM OIL

[75] Inventors: Edward G. Latimer, Bartlesville; Richard W. Jones, Dewey, both of Okla.

[73] Assignee: Phillips Petroleum Company, Bartlesville, Okla.

[21] Appl. No.: 181,285

[22] Filed: Apr. 14, 1988

[51] Int. Cl.[4] ..... C10G 29/06

[52] U.S. Cl. ..... 208/251 R; 208/180; 208/181; 208/183; 208/253; 585/853

[58] Field of Search ..... 208/251 R, 180, 181, 208/183, 253; 585/853

[56] References Cited

U.S. PATENT DOCUMENTS

| | | | |
|---|---|---|---|
| 3,105,038 | 9/1963 | Ayers | 208/251 R |
| 3,449,243 | 6/1969 | Strong et al. | 208/251 |
| 3,562,151 | 2/1971 | Langlois | 208/251 R |
| 4,256,528 | 3/1981 | Kozar | 208/183 |
| 4,269,698 | 5/1981 | Kreger | 208/180 |
| 4,274,943 | 6/1981 | McClaflin | 208/251 R |
| 4,325,809 | 4/1982 | Bartholic | 208/91 |
| 4,405,445 | 9/1983 | Kovach et al. | 208/120 |

OTHER PUBLICATIONS

"A Comprehensive Treatise on Inorganic and Theoretical Chemistry", by J. W. Mellor, vol. VI, 1925, pp. 317–325.

"Encyclopedia of Chemical Technology", by Kirk-Othmer, vol. 20, 1982, pp. 855–876.

"Encyclopedia of Chemical Technology", by Kirk-Othmer, vol. 22, 1983, pp. 332–360.

*Primary Examiner*—H. M. S. Sneed

*Attorney, Agent, or Firm*—K. K. Brandes

[57] ABSTRACT

A process for removing copper and/or iron impurities from a liquid hydrocarbon-containing feed comprises contacting the feed with an aqueous treating agent comprising water-soluble alkali metal silicate (in particular sodium silicate) and/or a surfactant, in particular an anionic surfactant.

20 Claims, No Drawings

REMOVAL OF COPPER AND IRON FROM OIL

BACKGROUND OF THE INVENTION

This invention relates to the removal of copper and/or iron impurities from a hydrocarbon containing oil.

Many liquid hydrocarbon containing feed streams, such as slop oils and FCC cracker feed oils contain copper impurities and/or iron impurities. Some of these copper and iron impurities are in substantially metallic form (such as tramp iron), others are in compound form (such as sulfides or oxides). Regardless of the form in which these copper and iron impurities exist, they can contribute to the deactivation of hydrocarbon conversion catalysts, especially cracking catalysts. Thus, it is most desirable to remove copper impurities and iron impurities from these hydrocarbon containing oils.

SUMMARY OF THE INVENTION

It is an object of this invention to provide a process for at least partially removing copper impurities and iron impurities from substantially liquid hydrocarbon containing feeds. Other objects and advantages will be apparent from the detailed description and the appended claims.

In accordance with this invention, a feed comprising substantially liquid hydrocarbons and also metal impurities selected from the group consisting of copper impurities, iron impurities and mixtures of copper and iron impurities is contacted with a treating agent comprising (a) water, and (b) at least one dissolved substance selected from the group consisting of water-soluble alkali metal silicates and anionic surfactants;

under such treating (contacting) conditions as to remove at least a portion of said metal impurities from said feed.

Preferably, the treating agent comprises (i) water glass (water-soluble sodium silicate) and (ii) at least one anionic surfactant or at least one non-ionic surfactant (i.e., at least one surfactant or two or more surfactants).

DETAILED DESCRIPTION OF THE INVENTION

Any suitable hydrocarbon containing feed (herein also referred to as "hydrocarbon containing feed stream") which is liquid at the contacting conditions and which contains copper impurities or iron impurities or, preferably, both copper and iron impurities can be employed in the demetallizing process of this invention. Suitable hydrocarbon containing feed streams include crude oils, fractions of crude oils (such as naphtha, gas oils and residua), slop oils, cycle oils, slurry oils, liquid petroleum products, liquid coal pyrolyzates, liquid products from extraction and/or liquefaction of coal (including lignite), liquid products from tar sands, shale oil, fractions of shale oil, extracts of lube oil feestocks, refinery waste streams, and the like, preferably a slop oil (to be used as at least a portion of a feed in a FCC cracking operations). Many of these feed streams also contain other metal impurities (such as vanadium and nickel compounds), sulfur compounds, nitrogen compounds, and Ramsbottom carbon residue (ASTM D524). Furthermore, water may be present in these feed streams.

Preferably, the hydrocarbon containing feed of this invention comprises from about 0.2 to about 3,000 ppmw Cu (parts by weight of Cu per million parts by weight of feed), more preferably about 0.5–20 ppmw Cu, and from about 0.5 to about 5,000 ppmw Fe, more preferably about 2–50 ppmw Fe. It is understood that the copper and iron impurities may be elemntal or inorganic compounds (e.s., oxides or sulfides) or organic components (e.g. carboxylates), and may be substantially dissolved or dispersed (including colloidally dispersed) in the hydrocarbon containing feed. The source of these impurities is not considered critical.

Generally the feed also contains about 1–1,000 ppmw V, about 0.5–500 ppmw Ni and about 0.1–7 weight-% S. Water can be present in the feed stream, at a level of up to about 20 weight-%, preferably at a level of about 0.1–10 weight-% $H_2O$. The API gravity (measured at 60° F.) of the feed generally is in the range of from about 5 to about 65, preferably about 15–40; and the initial boiling point (measured at 0 psig) is generally in excess of about 65° F., preferably in excess of about 200° F.

Component (b) of the treating agent can be any water-soluble alkali metal silicate, such as those described in Kirk-Othmer's "Encyclopedia of Chemical Technology", Volume 20, John Wiley and Sons, Inc., 1982, pages 855–876, the disclosure of which is herein incorporated by reference. The preferred alkali metal silicates are sodium silicates (including orthosilicate, pyrosilicate, metasilicate, polysilicate), more preferably those contained in water glass. Generally the mole ratio of $SiO_2$ to $Na_2O$ in the dissolved alkali metal silicate is in the range of from about 1.5:1 to about 4:1.

Component (b) of the treating agent can also be any anionic surfactant, such as those described in Kirk-Othmer's Encyclopedia of Chemical Technology, Volume 22, John Wiley and Sons, Inc., 1983, pages 332–360, the disclosure of which is herein incorporated by reference. Suitable anionic surfactants include (but are not limited to) alkali metal carboxylates containing 9–21 carbon atoms, ammonium carboxylates containing 9–21 C atoms, alkali metal and ammonium polyalkoxycarboxylates, alkali metal and ammonium alkyl sulfonates, alkali metal and ammonium alkylarylsulfonates, alkali metal and ammonium lignosulfonates, alkali metal and ammonium naphthylsulfonates, alkali metal and ammonium olefinsulfonates, alkali metal and ammonium alcohol sulfates, alkali metal and ammonium compounds of alkylphenols, alkali metal and ammonium compounds of sulfated oxyalkylated alkylphenols, alkali metal and ammonium compounds of oxyalkylated alkylphenol polyamines, alkali metal and ammonium compounds of alkyl polyether sulfates, alkali metal and ammonium compounds of mono- and diesters of phosphoric esters, and the like. Presently preferred are alkali metal salts and/or ammonium salts of alkaryl sulfonates. A particular preferred anionic surfactant is described in Example I.

Any suitable concentration of alkali metal silicate and of the anionic surfactant in the treating agent can be used. The concentration of alkali metal silicate in the treating agent generally it is the range of from about 5 to about 60 weight-% (more preferably about 20–50 weight-%). The concentration of the anionic surfactant in the treating agent generally is in the range of from about 0.01 to about 5 weight-% (more preferably about 0.02–2 weight-%). It is understood that other components, such as water-soluble alcohols (in particular isopropanol), esters, ketones and the like, may be present in the treating agent, provided that these other components do not interfere with the Cu/Fe removal process of this invention.

A preferred treating agent of this invention is an aqueous solution comprising a mixture of sodium silicate (water glass) and either at least one anionic surfactant (as defined above) or, alternatively, a non-ionic surfactant, such as polyether polyester condensation products, oxyalkylated alkylphenol/formaldehyde resins, diesters of oxyalkylated glycerin and dicarboxylic acids, and the like. If a non-ionic surfactant is present, its concentration in the treating agent is about 0.01–5 weight-%, preferably about 0.02–2 weight-%.

The process of this invention can be carried out in any apparatus whereby there is achieved an intimate contact of the treating agent with the hydrocarbon containing feed stream. The process is in no way limited to the use of particular apparatus. The process can be carried out as a continuous process or as a batch process. The term "hydrocarbon containing feed stream" is used herein to refer to both a continuous and batch process.

The hydrocarbon containing feed stream and the treating agent can be mixed in any suitable manner. In a continuous operation, it is preferred to mix a hydrocarbon feed stream with a stream of the treating agent, e.g., in a vessel equipped with a mechanical stirrer, or in a static mixer, or by means of a recirculating pump. In a batch operation, the above-cited mixing means can also be employed so as to provide a mixture of hydrocarbon containing feed and treating agent, or the hydrocarbon containing feed stream and the treating agent can be added to the reactor simultaneously or sequentially and can then be thoroughly mixed.

Any suitable amount of the treating agent can be employed. The maximum amount of the treating agent employed in the process of this invention is primarily determined by the level of Cu and Fe impurities present and by economic factors such as material and equipment costs. The weight ratio of treating agent to hydrocarbon containing feed ranges generally from about 1:30 to about 2:1, preferably from about 1:20 to about 1:1, more preferably from about 1:10 to about 1:5.

Any suitable treating time, i.e., time of contact between treating agent and the hydrocarbon containing feed stream, can be utilized. In general, the contact time can range from a minimal time necessary to partially demetallize the hydrocarbon containing feed stream to a maximum economically feasible time to remove a major portion (preferably at least about 80%) of Cu and Fe from the hydrocarbon containing feed stream. Preferably, the contact time will range from about 2 seconds to about 5 hours, more preferably from about 2 to about 60 minutes. The optimal contact time will depend on the temperature of the treating temperature (longer contact times are needed at lower temperatures and vice versa).

In a continuous process, the flow rates of the hydrocarbon feed stream and of the treating agent should be such that the time required for the passage of the mixture of feed and agent through the reactor (residence time) will preferably be in the range of about 2 seconds to about 5 hours, more preferably from about 2 to about 60 minutes. In a batch process, the mixture should simply remain in the reactor under reaction conditions for a time preferably in the range of about 2 seconds to about 5 hours, more preferably from about 2 to about 60 minutes (again generally referred to as residence time).

The demetallization process of the present invention can be carried out at any suitable temperature. The temperature will generally range from a minimal demetallizing temperature to any economically practical temperature. Preferably, the temperature will be in the range of about 5° C. to about 100° C., more preferably about 15° C. to about 40° C.

A gas can also be present during the mixing of the hydrocarbon containing feed stream and treating agent. The presence of a gas allows high pressure operation to be achieved. Gases such as hydrogen, air, inert gases (e.g. nitrogen), methane and carbon dioxide can be utilized.

Any suitable pressure can be utilized in the process. The reaction pressure can range from about atmospheric (0 psig) to any economically practical high pressure, such as 100 psig.

Geneally, after the demetallizing process of this invention has been completed, the hydrocarbon containing product, i.e., the feed from which at least a portion of Cu and Fe have been removed, and the aqueous treating agent are allowed to form two separate layers (with the hydrocarbon containing product layer generally being on top of the aqueous layer). The separation into two layers can be accomplished in any vessel, and the two separated layers can then be pumped out or drained off. The copper and iron impurities are concentrated in the aqueous treating agent, either in dissolved or dispersed form (including colloidally dispersed form).

The aqueous treating agent containing the metal impurities (removed from the hydrocarbon containing feed stream) can, optionally, undergo further treatment, such as filtration or flotation, so as to recover the copper and iron impurities therefrom. The treating agent, from which the metal impurities have thus been substantially removed, can be reused, generally admixed with additional fresh components (a) and (b), in the demetallizing process of this invention.

The hydrocarbon containing product stream generally undergoes further processing such as catalytic hydrotreating (for removal of sulfur, nitrogen, vanadium, nickel and the like), hydrocracking and/or catalytic cracking (e.g., in a FCC cracking unit), and the like. The product may also be separated into different fractions by distillation before one or all fractions of the product are further processed, as described above. The process for removing copper and iron of this invention is especially beneficial when the hydrocarbon containing product stream, optionally blended with one or more other hydrocarbon containing stream, is used as feed for catalytic cracking processes employing zeolite-containing cracking catalysts (which are deactivated by copper and iron impurities).

The following example is presented to further illustrate the invention, without unduly limiting the scope of this invention.

EXAMPLE

A heavy slop oil from a refinery of Phillips Petroleum Company in Borger, TX was treated in accordance with the process of this invention so as to remove copper and iron impurities from the slop oil. The heavy slop oil was a sample of a skimmer stream from a natural gas liquid heater (which employed copper chloride as treating agent). The heavy slop oil contained about 5 ppmw Cu (i.e., 5 parts by weight of Cu per one million parts by weight of oil), and about 27 ppmw Fe (probably introduced from corroded steel pipes and vessels). However, in the course of several weeks the copper and iron contents in the slop oil gradually decreased, probably because of oxidation and subsequent setting of the metal impurities. Thus, Cu and Fe contents in the slop oil feed samples were remeasured at intervals of about 1–2 weeks.

The treating procedure for removal of Cu and Fe impurities comprised shaking of 50 cc (mL) slop oil in a glass vessel, submerged in a water bath, with an aqueous treating agent 100 times, and then allowing the oil phase and the water phase to separate. A sample of the oil product was taken and analyzed (by plasma emission analysis) for Cu and Fe contents. Test results are summarized in Table I.

TABLE I

| Run | ppmw (Cu + Fe) in Oil Feed | Temp. (°F.) | Treating Agent[4] | ppmw Metal in Oil Product Cu | Fe | (Cu + Fe) | % Removal of (Cu + fe) |
|---|---|---|---|---|---|---|---|
| 1 | 32.5[1] | 140 | 20% $H_2O$ + 0.2% RI-57[5] | 0.2 | 10.4 | 10.6 | 67 |
| 2 | 32.5 | 140 | 20% Water Glass[6] | 5.7 | 8.8 | 14.5 | 55 |
| 3 | 32.5 | 80 | 20% Water Glass | 4.8 | 2.4 | 7.2 | 78 |
| 4 | 24.6[2] | 80 | $H_2O$ | 2.5 | 15.5 | 18.0 | 27 |
| 5 | 24.6 | 80 | 20% $H_2O$ + 0.1% RI-57 | 0.2 | 9.0 | 9.2 | 63 |
| 6 | 24.6 | 80 | 20% Water Glass | 3.8 | 14.0 | 17.8 | 28 |
| 7 | 24.6 | 80 | 20% Water Glass + 0.1% RI-57 | 1.4 | 2.1 | 3.5 | 86 |
| 8 | 24.6 | 80 | +10% Water Glass | 4.1 | 17.1[7] | 21.2[7] | 14[7] |
| 9 | 24.6 | 80 | 10% $H_2O$ + 10% Water Glass + 0.1% RI-57 | 0.4 | 2.3 | 2.7 | 89 |
| 10 | 19.0[3] | 80 | 10% $H_2O$ | 2.2 | 14.8 | 17.0 | 11 |
| 11 | 19.0 | 80 | 10% $H_2O$ + 0.04% RI-57 | 0.8 | 9.7 | 10.5 | 45 |
| 12 | 19.0 | 80 | 10% $H_2O$ + 0.2% RI-57 | 0.4 | 7.7 | 8.1 | 57 |
| 13 | 19.0 | 80 | 10% $H_2O$ + 10% Water Glass + 0.1% RI-57 | 0.9 | 4.4 | 5.3 | 72 |
| 14 | 19.0 | 80 | 10% $H_2O$ + 10% Water Glass + 0.04% RI-57 | 3.7[8] | 11.8 | 15.5[8] | 18[8] |
| 15 | 19.0 | 80 | 10% $H_2O$ + 1% Water Glass + 0.1% RI-57 | 1.2 | 6.1 | 7.3 | 62 |

[1]Oil feed contained 5.2 ppmw Cu and 27.3 ppmw Fe (Runs 1–3)
[2]Oil feed contained 4.6 ppmw Cu and 20.0 ppmw Fe (Runs 4–9)
[3]Oil feed contained 2.4 ppmw Cu and 16.6 ppmw Fe (Runs 10–15)
[4]All percentages are weight % of each ingredient in the total mixture of oil feed aqueous treating agent
[5]RI-57, now marketed under the product designation of RP 0057, provided by Petrolite Corporation, St. Louis, MO; a mixture of sulfated oxyalkylated alkylphenols, oxyalkylated alkylphenol polyamines, alkyl polyether sulfate, phosphates and alkaryl sulfonates in water and isopropanol; specific gravity at 60° F.; 1.05; pH: 11.6
[6]An aqueous solution of sodium silicate having a specific gravity of 40–42°Be' (degree Baume')
[7]Results are erroneous; Fe content in product was higher than Fe content in feed
[8]Results are erroneous; Cu content in product was higher than Cu content in feed Test data in Table I show that aqueous solutions of sodium silicate (water glass) and of an anionic surfactant (RI-57) were more effective in extracting copper and iron impurities from an oil than water alone. The most effective extracting agent contained both sodium silicate and RI-57 surfactant. Treating the oil feed of 80° F. was more effective for Cu/Fe removal than treatment at 140° F. (compare run 2 with run 3).

Additional tests indicated that aqueous solutions containing sodium silicate and non-ionic surfactants were substantially as effective as aqueous solutions containing sodium silicate and RI-57. Non-ionic surfactants which were tested (in lieu of RI-57) in conjunction with water glass included Nalco 5537 (a complex mixture of polyether polyester condensation products in aromatic solvents), Nalco 5543 (a blend of oxyalkylated/resin adduct esters and oxyalkylated alkylphenol/formaldehyde resin in an aromatic solvent), Nalco 5545 (an oxyalkylated alkylphenol/formaldehyde resin) and Nalco 5552 (oxyalkylated glycerin and diacid ester in a hydrocarbon solvent), all supplied by Nalco Chemical Company, Oak Brook, IL.

Further tests employing a skimmer stream from a natural gas liquids plant as feed, which contained 1760 ppmw Cu (mainly as CuS), revealed that shaking for 6 hours at 175° F. (essentially in accordance withe the above-described procedure) with 10% water glass (described above) and 20% water glass, respectively, resulted in copper removal of 42% and 77%, respectively. Treatment with 0.2% RI-57 resulted in 20% Cu removal; treatment with a mixture of 20% water glass and 0.2% RI-57 resulted in 36% Cu removal; and treatment with a mixture of 20% sulfuric acid (containing 0.3 weight-% $H_2SO_4$) and 0.1% RI-57 resulted in 83% Cu removal.

Reasonable variations, modifications and adaptations for various usages and conditions can be made with the scope of the disclosure and the appended claims, without departing from the scope of this invention.

That which is claimed is:

1. A demetallizing process which comprises contacting a feed comprising substantially liquid hydrocarbons and also metal impurities selected from the group consisting of copper impurities, iron impurities and mixtures of copper and iron impurities with a treating agent comprising water and at least one dissolved substance selected from the group consisting of water-soluble alkali metal silicates, under such treating conditions as to remove at least a portion of said metal impurities from said feed.

2. A process in accordance with claim 1 wherein said treating agent comprises sodium silicate.

3. A process in accordance with claim 2 wherein the concentration of said sodium silicate in said treating agent is in the range of from about 5 to about 60 weight-%.

4. A process in accordance 2 wherein the weight ratio of said treating agent to said feed is in the range of from about 1:30 to about 2:1.

5. A process in accordance with claim 1 wherein said treating agent additionally comprises at least one anionic surfactant.

6. A process in accordance with claim 5 wherein said treating agent additionally comprises a water-soluble alcohol.

7. A process in accordance with claim 1 wherein said feed contains both copper impurities and iron impurities.

8. A process in accordance with claim 1 wherein said feed is an oil having an API gravity in the range of from about 5 to about 65, and has an initial boiling point in excess of about 65° F.

9. A process in accordance with claim 8 wherein said oil contains about 0.2–3,000 ppmw Cu and about 0.5–5,000 ppmw Fe.

10. A process in accordance with claim 1 wherein said treating conditions comprise a treating time in the range of from about 2 seconds to about 5 hours, a treating temperature in the range of from about 5° C. to about 100° C., and atmospheric pressure conditions.

11. A process in accordance with claim 1 additionally comprising the steps of forming a layer containing the treated feed, from which at least a portion of said metal impurities have been removed, and another layer containing the aqueous treating agent, which contains said at least partially removed metal impurities, and separating the formed two layers from one another.

12. A process in accordance with claim 11 comprising the additional steps of removing said metal impurities contained in said aqueous treating agent, and recycling the aqueous treating agent from which said metal impurities have been removed to the zone where said feed and said treating agent are contacted under said treating conditions.

13. A process in accordance with claim 1, wherein said treating agent comprises water, sodium silicate and at least one anionic surfactant.

14. A process in accordance with claim 13 wherein said anionic surfactant is selected from the group consisting of ammonium salts of alkaryl sulfonates and alkali metal salts of alkaryl sulfonates.

15. A process in accordance with claim 13 wherein the concentration of said anionic surfactant in said treating agent is in the range of from about 0.01 to about 5 weight-%.

16. A process in accordance with claim 13 wherein the weight ratio of said treating agent to said feed is in the range of from about 1:30 to about 2:1.

17. A process in accordance with claim 1, wherein said treating agent comprises water, sodium silicate and at least one non-ionic surfactant.

18. A process in accordance with claim 17 wherein said at least one surfactant is a non-ionic surfactant selected from the group consisting of polyether polyester condensation products, oxyalkylated alkylphenol/formaldehyde resins, and diesters of oxyalkalated glycerin and dicarboxylic acids.

19. A process in accordance with claim 17 wherein the weight ratio of said treating agent to said feed is in the range of from about 1:20 to about 1:1.

20. A process in accordance with claim 17, wherein the concentration of said at least one non-ionic surfactant in said treating agent is in the range of from about 0.01 to about 5 weight-%.

* * * * *